US011965291B2

(12) United States Patent
Schwaiger et al.

(10) Patent No.: US 11,965,291 B2
(45) Date of Patent: Apr. 23, 2024

(54) PACKING PAPER

(71) Applicant: MONDI AG, Vienna (AT)

(72) Inventors: Elisabeth Schwaiger, St. Stefan (AT); Johannes Rosenwirth, Villach (AT)

(73) Assignee: MONDI AG, Vienna (AT)

( * ) Notice: Subject to any disclaimer, the term of this patent is extended or adjusted under 35 U.S.C. 154(b) by 0 days.

(21) Appl. No.: 17/836,077

(22) Filed: Jun. 9, 2022

(65) Prior Publication Data

US 2022/0403602 A1 Dec. 22, 2022

(51) Int. Cl.

| | |
|---|---|
| ***D21H 27/10*** | (2006.01) |
| ***D21G 1/02*** | (2006.01) |
| ***D21H 11/04*** | (2006.01) |
| ***D21H 17/17*** | (2006.01) |
| ***D21H 17/19*** | (2006.01) |
| ***D21H 17/29*** | (2006.01) |
| ***D21H 17/37*** | (2006.01) |
| ***D21H 17/66*** | (2006.01) |
| ***D21H 17/68*** | (2006.01) |
| ***D21H 19/40*** | (2006.01) |
| ***D21H 19/58*** | (2006.01) |
| ***D21H 19/84*** | (2006.01) |
| ***D21H 21/16*** | (2006.01) |
| ***D21H 21/18*** | (2006.01) |
| ***D21H 27/02*** | (2006.01) |

(52) U.S. Cl.

CPC ..... *D21H 27/10* (2013.01); *D21G 1/0233* (2013.01); *D21H 11/04* (2013.01); *D21H 17/17* (2013.01); *D21H 17/19* (2013.01); *D21H 17/29* (2013.01); *D21H 17/375* (2013.01); *D21H 17/66* (2013.01); *D21H 17/68* (2013.01); *D21H 19/40* (2013.01); *D21H 19/58* (2013.01); *D21H 19/84* (2013.01); *D21H 21/16* (2013.01); *D21H 21/18* (2013.01); *D21H 27/02* (2013.01)

(58) Field of Classification Search

CPC ..... D21H 27/10; D21H 11/04; D21H 17/17; D21H 17/19; D21H 17/29; D21H 17/375; D21H 17/66; D21H 17/68; D21H 19/40; D21H 19/58; D21H 19/84; D21H 21/16; D21H 21/18; D21G 1/0233

USPC ..... 162/112

See application file for complete search history.

(56) References Cited

U.S. PATENT DOCUMENTS

2004/0229044 A1* 11/2004 Goto ..... G03G 15/6591 430/124.35

2021/0102340 A1 4/2021 Nordling et al.

FOREIGN PATENT DOCUMENTS

| | | |
|---|---|---|
| EP | 2449176 | 9/2016 |
| EP | 3168362 | 5/2017 |
| WO | WO 2020/120535 | 6/2020 |

* cited by examiner

*Primary Examiner* — Mark Halpern

(74) *Attorney, Agent, or Firm* — Jacobson Holman PLLC

(57) ABSTRACT

Packaging paper consisting of an unbleached kraft paper with a kappa value according to ISO 302:2015 between 38 and 60, preferably between 40 and 58 as base paper, which is optionally coated on at least one side, wherein the kraft paper is made of at least 90% primary pulp, has a basis weight according to ISO 536:2019 between 60 g/m$^2$ and 150 g/m$^2$ and an air resistance according to ISO 5636-5:2013 (Gurley) between 5 and 30 seconds, wherein the base paper has an elongation at break in the machine direction according to ISO 1924-3:2005 between 2.5% and 8.5% and has a Bendtsen roughness according to ISO 8791-2:2013 between 70 ml/min and 600 ml/min, preferably between 150 ml/min to 550 ml/min, more preferably 200 ml/min to 500 ml/min, and process for its production.

11 Claims, No Drawings

PACKING PAPER

BACKGROUND OF THE INVENTION

The present invention relates to a packaging paper comprising an unbleached kraft paper with a kappa value according to ISO 302:2015 of between 38 and 60, preferably between 40 and 58 as base paper, which is optionally coated on at least one side, the kraft paper being made of at least 90% primary pulp, having a basis weight according to ISO 536:2019 of between 60 g/m$^2$ and 150 g/m$^2$ and an air resistance according to ISO 5636-5:2013 (Gurley) of between 5 and 30 seconds, and to a process for the production of a packaging paper, in which an unbleached kraft pulp consisting of at least 90% primary pulp, containing at least 80%, preferably at least 85%, in particular at least 88% pulp with an average length-weighted fiber length according to ISO 16065-2:2014 of between 2.0 mm and 2.9 mm as well as less than 4.5%, preferably less than 4.2%, in particular less than 4.0% fillers as well as cationic starch in an amount of 0.5% by weight to 1.5% by weight of the base paper, in particular from 0.6% by weight to 1.4% by weight of the base paper, and other processing agents, with a kappa value according to ISO 302:2015 of between 38 and 60, preferably between 40 and 58, is used as the base material.

Packaging papers are used in a wide variety of applications and must have certain properties depending on the goods to be packaged in them. What all packaging papers have in common is that they must not tear and must be resistant to mechanical and, to a certain extent, also to chemical and moisture stresses so that the goods packaged in them are neither damaged nor lost, e.g., by tearing of a bag or other container. These requirements are usually particularly well met by packaging made of kraft paper, which is the paper grade with the highest strength. Kraft paper can be used to make heavy-duty bags, e.g., for construction materials, bags for sharp-edged materials such as gravel or screws, but also for shopping bags, bags or pouches for packaging food or containers for toys. Furthermore, kraft paper and kraft pulp are used for the production of corrugated board or cardboard, in which case, however, papers with a basis weight of over 120 g/m$^2$ are usually used.

In addition to its high resistance, kraft paper or packaging paper must generally also be easy to print on, and, moreover, have material properties that should be precisely adapted to the goods to be packaged or stored in it. For example, kraft paper can be (micro)creped in a Clupak machine, which increases its elongation at break, especially the elongation at break in the machine direction, which means that, for example, heavy materials such as sand can be packed in containers made of kraft paper without fear of them tearing, even if the filled and sealed packages or containers fall to the ground, for example from a height of more than one meter. In the case of packaging made of kraft paper for building materials, however, other important properties of the packaging, such as sufficient air permeability, moisture resistance or barrier properties against moisture and printability for the packaging paper, must be ensured in order to ensure that the packaging, such as bags, pouches or sacks, can be filled quickly on the one hand, are sufficiently stable during transport and storage and, on the other hand, important information can be printed quickly and permanently on the packaging without, for example, a fading or bleeding of the inks.

It is known to the person skilled in the art that usually the improvement of one property of the packaging paper is accompanied by the deterioration of another property, such as, for example, the higher the elongation at break of a paper, which is achieved, for example, by (micro)creping in a Clupak machine, the poorer the printability of the paper due to the (micro)creped surface and the resulting higher roughness thereof. Another well-known correlation is, for example, that the greater the basis weight of a paper, the lower its air permeability becomes, unless this is counteracted by regulating the corresponding refining power during production, which, however, usually in turn has a negative effect on the strength properties of the paper.

It is known to the person skilled in the art that the properties of kraft paper can be influenced by specifically selected additives or processing steps, just as the choice of wood from which the fibers forming the paper originate can influence the paper properties. For example, at least one side of a calendered kraft paper is very smooth and can therefore be easily printed. Excessive calendering can thus form a smooth surface on at least one side of the paper, but on the other hand such a measure usually worsens the elongation at break of the paper, especially for example in the machine direction, as well as many other mechanical properties of the paper, as a result of which the packaging loses elasticity and is in danger of tearing under large loads. Another known measure to ensure that the paper properties can be kept as uniform as possible is, for example, that, in order not to worsen the air permeability when the basis weight of the paper is increased, the freeness of the fiber suspension from which the paper is formed, is changed and, for instance, reduced, so that the air permeability of the paper is kept as constant as possible despite the changing basis weight.

The use of unbleached pulp, which has relatively stiffer pulp fibers compared to bleached pulp, and the associated use of reduced amounts of process chemicals, particularly those required for bleaching, also provides a packaging paper that is particularly well suited as a paper for packaging construction materials, etc., due to its extensibility, which is in the middle range of achievable elongations at break for kraft papers, such as sack kraft papers, but which has significant deficiencies in terms of surface smoothness and printability.

From WO 2020/120535 A1 a hot extraction paper has become known, which essentially consists of pulp as well as manufacturing aids absolutely necessary for cellulose production, such as a pH adjusting agent based on acids and/or bases. The starting material for such hot extraction papers is subjected to both high consistency refining and low consistency refining, as well as other process steps also known for the production of kraft papers but differs substantially in the mechanical properties required for a kraft paper.

Furthermore, sack papers with vapor barriers have become known, for example, from EP 2 449 176 B1, which vapor barriers can be achieved by applying polymer materials such as Ethylene-Propylene Copolymers.

Highly extensible papers have also become known, for example, from US 2021/0102340 A1, the extensibility of which is obtained by high or low consistency refining steps and compacting or micro creping on a Clupak system.

EP 3 168 362 A1 describes a paper for a vertical form-fill-seal machine, wherein the starting material forming this paper was subjected to both high and low consistency refining, which was further pressed in a shoe press as well as creped in a Clupak plant.

SUMMARY OF THE INVENTION

The present invention thus aims at providing a packaging paper which is made of unbleached kraft paper, and which has both the strength properties of conventional kraft paper grades and, in addition, a smooth surface excellently suited for further processing steps, such as surface coating and/or printing, in particular printing with mass printing methods.

To solve this task, the packaging paper is essentially characterized in that the primary pulp contained in the base paper comprises at least 80%, preferably at least 85%, in particular at least 88% pulp with an average length-weighted fiber length according to ISO 16065-2:2014 of between 2.0 mm and 2.9 mm, as well as less than 4.5%, preferably less than 4.2%, in particular less than 4.0% fillers and cationic starch in an amount of 0.5% by weight to 1.5% by weight, in particular 0.5% by weight to 1.4% by weight of the base paper and other processing agents, that the base paper has an elongation at break in the machine direction according to ISO 1924-3:2005 of between 2.5% and 8.5%, and that the packaging paper has a Bendtsen roughness according to ISO 8791-2:2013 of between 70 ml/min and 600 ml/min, preferably between 150 ml/min to 550 ml/min, in particular preferably 200 ml/min to 500 ml/min. By packaging paper being formed such that the base paper contains at least 90% primary pulp, containing at least 80%, preferably at least 85%, in particular at least 88% pulp with an average length-weighted fiber length according to ISO 16065-2:2014 between 2.0 mm and 2.9 mm as well as less than 4.5%, preferably less than 4.2%, in particular less than 4.0% fillers as well as cationic starch and other processing agents, it is possible to provide a kraft paper with an extremely tear-resistant structure and, in particular, due to an optimum utilization of the length distribution of the fiber lengths of the primary pulp used, to adjust the paper properties as precisely as possible both in the machine direction and in the cross direction. Such paper can be safely and reliably used for packaging sharp-edged objects or heavy materials, such as gravel, due to its resistance and its ability to be (micro) creped in a Clupak machine. By further containing less than 4.5%, preferably less than 4.2%, in particular less than 4.0% (the percentages indicated are always to be understood as percentages by weight in the context of the present invention) fillers as well as cationic starch and processing aids, it is possible to obtain at the same time a resistant but not excessively stiff base paper, in which high percentages of starch, in particular cationic starch can be used due to the lignin and hemicelluloses remaining in the base paper and the associated high number of negative charges. Due to these high starch contents of the base paper, it is possible to provide excellent mechanical properties of the paper and at the same time to keep the open porosity of the paper high and thus to counteract an overall densification of the paper structure in a calendering step and subsequently to provide a well-structured and yet smoothed surface for a subsequent coating of the paper, if necessary. By having an elongation at break in the machine direction according to ISO 1924-3: 2005 of between 2.5% and 8.5%, the packaging paper is sufficiently flexible to withstand high elongation stresses, such as when filled packages are dropped, and at the same time succeeds in providing a packaging paper that has a smooth surface with low Bendtsen roughness according to ISO 8791-2:2013 of between 70 ml/min and 600 ml/min. These properties can be achieved in particular by using unbleached kraft paper with a kappa value according to ISO 302:2015 of between 38 and 60, preferably between 40 and 58, which has relatively stiffer fibers compared to bleached paper, but has been subjected to milder manufacturing conditions due to the lack of bleaching. By applying these milder manufacturing conditions, it is possible to retain a lot of residual lignin in the paper, resulting in more negatively charged sites in the fiber network compared to bleached paper, which negatively charged sites subsequently allow the paper to be loaded with more starch compared to bleached paper. Furthermore, by making at least 90% of the kraft paper from primary pulp, it is possible to further increase the tensile strength due to the extremely low content of possible recycled or recovered paper fibers, in contrast to conventional kraft paper grades on the market, thus enabling kraft papers with high TEA indices (Tensile Energy Absorption Index, according to ISO 1924-3:2005) to be achieved. High TEA indices are important for the mechanical stability of the paper, but on the other hand they are not optimal for the printability of the paper and it has been shown, surprisingly, that by using unbleached pulp and the associated possibility of incorporating increased amounts of starch into the kraft paper, it is possible not only to keep the TEA index high and at the same time to apply mild conditions in the manufacture of the paper, but also, and due to the use of relatively high amounts of starch, in particular corn starch, potato starch or the like, to maintain the open pores of the paper and thus its air permeability at a high level. By using relatively high amounts of cationic starch compared to bleached kraft paper, it is possible to keep the air permeability (Gurley according to ISO 5636-5:2013) high through flocculation resulting from the interaction between the negatively charged fibers and the positively charged starch, or to keep the air resistance of the packaging paper produced in this way low, so that it is possible to calender the paper to achieve the surface smoothness necessary for good printing. Calendaring causes densification and thus reduction of the air permeability of the paper, but surprisingly, a combination consisting of the use of an unbleached, (micro)creped paper subjected to calendering succeeds in providing a packaging paper that has both good mechanical properties, such as an elongation at break in the machine direction between 2.5% and 8.5%, and excellent smoothness, in particular Bendtsen roughness according to ISO 8791-2:2013 in the range between 70 ml/min and 600 ml/min, preferably between 150 ml/min to 550 ml/min, more preferably 200 ml/min to 500 ml/min.

According to a further development of the invention, the packaging paper is further characterized in that the base paper is coated on at least one side with a coating material selected from the group of polyolefins, such as Polyethylene, Polypropylene, Polyolefin-based Copolymers and Terpolymers, and Ionomers or from the group of Polyolefin-free coating materials, such as Polylactic acid. By coating the base paper on at least one side with a coating material selected from the group of Polyolefins, such as Polyethylene, Polypropylene, Polyolefin-based Copolymers and Terpolymers as well as Ionomers or the group of Polyolefin-free coating materials, such as, e.g., Polylactic acid or other coating materials known in the art, it is possible to provide a flexible barrier coating that not only further reduces surface roughness and thus improves printability, but also does not adversely affect the elasticity or elongation at break of the packaging paper. An open porosity of the base paper has proven to be particularly advantageous, for example, in the extrusion coating of Polyethylene or other Polyolefin-based Copolymers, since this favors an inflow of the Polyethylene melt into the paper structure and thus a mechanical interlocking and anchoring of the coating material on or in the paper.

Here, a remaining low roughness between 70 and 200 ml/min of the packaging paper has proven to be favorable for the mechanical interlocking of the packaging paper with, e.g., a polymer melt. At Bendtsen roughnesses between 70 and 200 ml/min, such interlocking is surprisingly successful, while at the same time achieving much improved, high-quality printability (for example, in flexographic printing). If the printability requirements are not so high, higher Bendtsen roughnesses can also be set without adversely affecting other properties of the packaging paper.

By applying in correspondence to a further development of the invention, the coating on each side of the base paper in an amount between 1% and 7% by weight, in particular between 2% and 6% by weight of the basis weight of the base paper, it is furthermore possible to apply extremely thin coatings to the base paper without adversely affecting the stretchability of the packaging paper, while at the same time significantly improving the printability and in particular also the moisture resistance of the packaging paper. In particular, if the amount of coating material is selected at the lower end of the claimed amount, packaging papers are obtained whose mechanical properties are substantially equal to packaging papers without coating, but with a much smoother surface and thus improved printability and moisture resistance. Such a coating can be present as a so-called smooth finish on the surface of the base paper, which furthermore also positively influences the optical properties of the base paper, in terms of a velvety gloss of the base paper and a nice smooth surface with an even significantly lower Bendtsen roughness in the range between 50 ml/min and 500 ml/min. By applying Polyethylene, for example, the packaging paper is additionally provided with a heat-sealable sealing layer, the seal having sufficient sealing strength both in the case of a single-sided coating at the paper-polymer interface and in the case of a double-sided coating at the polymer-polymer interface. Furthermore, papers coated on one side, for example, can also be folded in further processing in such a way that contact is made between two coated areas, making it unnecessary, for example, to apply an additional adhesive component or adhesive layer when producing containers such as sacks, bags, or pouches from the packaging paper.

In particular, in order to prevent the possible negative influences of recycled pulp as well as of pulp from waste paper on the properties of the end product, such as reduced strength, reduced TEA index, reduced elongation at break, and the like, all of which cannot be predicted due to the unknown origin of, for example, pulp from waste paper, the packaging paper according to the invention is preferably designed further in such a way that the pulp used is 100% primary pulp. The advantages of using 100% primary pulp for packaging materials in the food packaging materials sector are well known to the person skilled in the art. Reference is made here only by way of example to the full use of packaging papers made from 100% primary pulp for dry, moist, and high-fat foodstuffs with no or very little additional testing and analysis of the paper material. This also requires careful selection of process additives and their reduced use, as achieved in the present packaging paper according to the invention.

In particular, in order to positively influence not only the strength properties of the packaging paper but also its surface smoothness, according to a further development of the invention the packaging paper is designed in such a way that the primary pulp consists of a mixture of at least 80% softwood pulp, preferably at least 90% softwood pulp, in particular at least 95% softwood pulp with an average length-weighted fiber length according to ISO 16065-2:2014 of at least 2.0 mm, and balance hardwood pulp having an average length-weighted fiber length according to ISO 16065-2:2014 of at least 1.0 mm. Due to the predominant amount of softwood pulp with an average length-weighted fiber length according to ISO 16065-2:2014 of at least 2.0 mm and the remainder hardwood pulp with an average length-weighted fiber length according to ISO 16065-2:2015 of at least 1.0 mm, the strength properties can be positively influenced by the softwood pulp and the smoothness by the hardwood pulp, and a packaging paper with both excellent mechanical properties, in particular elongation at break, and a good smoothness, which provides the best printability, can be provided by a specific choice of pulp composition. Both pulp grades are preferably used as primary pulp and are particularly suitable for food packaging but also, for example, in the area of packaging for children's toys, due to their reduced content of process additives.

In correspondence to a further development of the invention, the packaging paper is being designed in such a way that the primary pulp is in the form of refined, in particular high consistency refined pulp with a Schopper-Riegler freeness according to ISO 5267-1:1999 between 13° SR to 20° SR, it is possible to further equalize the average fiber length of the pulp, whereby in particular a particularly homogeneous paper can be formed, in which an optimum adjustment of the paper properties can be achieved both in the longitudinal and in the transverse direction. In this case, the high consistency refining is preferably used to adjust the elongation at break of the packaging paper in the transverse direction. In addition to high consistency refining, the paper can also be low consistency (LC)-refined, with a Schopper-Riegler freeness according to ISO 5267-1:1999 of between 15 and 27° SR. With such low consistency refining, strength properties of the paper, such as tensile strength in the longitudinal and transverse directions, are adjusted and thus, by means of HC and LC refining, it is possible to further adapt the properties of the paper to the respective requirements.

In this context, high consistency refining is understood to mean refining in which the total consistency of solids is between 25% and 40%, and low consistency refining is understood to mean refining in which the total consistency of solids is between 2% and 7%.

The present invention is further directed to a process for the production of a packaging paper, which method succeeds in providing a paper having excellent mechanical properties as well as a smooth surface. To solve this task, the process according to the invention is conducted in such a way that the base material is creped in a Clupak plant until an elongation at break in the machine direction according to ISO 1924-3:2005 of between 2.5% and 8.5% is achieved, then dried to a moisture content of at most 14% and finally the base paper is subjected to a calendering step, whereby a packaging paper with a Bendtsen roughness according to ISO 8791-2:2013 between 70 ml/min and 600 ml/min, preferably 150 ml/min to 550 ml/min, more preferably 200 ml/min to 500 ml/min, a basis weight according to ISO 536:2019 between 60 g/m$^2$ and 150 g/m$^2$ and an air resistance according to ISO 5636-5:2013 (Gurley) between 5 and 30 seconds is formed, and that optionally at least one one-sided coating of the packaging paper is carried out. By creping the base material in the Clupak machine, it is possible to achieve an elongation at break in the machine direction according to ISO 1924-3:2005 in the range between 2.5% and 8.5%, which is a sufficient value to use the packaging material for packaging, for example, building materials, sand, gravel or pellets, foodstuffs such as rice and the like. By enabling to dry the paper to a moisture content of 14% or less, it is ensured that the paper remains sufficiently flexible and malleable despite the unbleached kraft pulp fibers it contains, which are stiffer overall. By further subjecting the paper to a calendering step, it is ensured that at least one side of the paper is smoothed again after processing in the Clupak plant, and this process step is carried out in such a way that the smoothing is preferably only carried out on one side, with particular care being taken that the (micro)creping introduced by the Clupak plant is not destroyed by the calendering, in order to keep the elongation at break of the paper high. Such process control makes it possible to achieve a packaging paper with a Bendtsen roughness according to ISO 8791-2:2013 between 70 ml/min and 600 ml/min, preferably between 150 ml/min to 550 ml/min, more preferably 200 ml/min to 500 ml/min, and a basis weight according to ISO 536:2019 between 60 g/m$^2$ and 150 g/m$^2$. A packaging paper produced in this way further shows an air resistance according to ISO 5636-5: 2013 (Gurley) between 5 and 30 seconds, which is on the one hand sufficiently permeable to allow, for example, entrained air to escape through the pores of the packaging during rapid filling of various types of containers, such as bags, sacks or pockets with filling materials, and on the other hand sufficiently dense that the stability of the packaging made from the paper can be maintained under large loads, since the pores formed are sufficiently large for use as packaging paper and small enough not to adversely affect the stability of the paper. If necessary, these process steps can be followed by a step of one-sided coating of the packaging paper.

According to a further development of the invention, the process is conducted in such a way that the calendering step is carried out in a shoe calender with a line load of between 200 and 1000 kN/m and a shoe length of 50 mm to 270 mm or a soft-nip calender with a line load of 18 to 80 kN/m, especially 20 to 50 kN/m. Using a shoe calender with a line load between 200 and 1000 kN/m for the calendering step ensures that the paper is not pressed too hard and that the (micro)creping introduced by the Clupak system is not destroyed again by the shoe calender. The same applies if a soft-nip calender with a line load of 18 to 80 kN/m is used. By carrying out an additional coating step in which the base paper is coated with either an olefinic coating, such as Polypropylene, Polyethylene, Polyolefin-based Copolymers and Terpolymers as well as Ionomers, or a non-polyolefinic coating, such as Polylactic acid, it is possible, on the one hand, to further increase the smoothness of the paper at least on one side and, on the other hand, to further increase properties such as the printability, moisture resistance and the like of the base paper or kraft paper and thus to produce a packaging paper which, due to its smoothness, can be excellently printed and coated, but at the same time also has mechanical properties that meet all the requirements of a modern packaging paper.

According to a further development of the invention, the coating step is conducted in such a way that an amount of coating material between 2% and 7%, in particular, 2.5% and 6%, of the basis weight of the base paper is applied to each side to be coated of the kraft paper constituting the base paper. The application of such small amounts of coating material ensures that not all pores of the packaging paper are stuck or closed by the coating material and that the paper has a smooth surface that is easy to print on and can also be heat-sealed, for example.

In accordance with a further development of the invention, the process is carried out in such a way that the coating is applied on at least one side that is creped in the Clupak system, thus ensuring that the coating adheres well to the surface and at the same time while the packaging paper as a whole is not too smooth and also has excellent printability. This is also reflected in particular by low Bendtsen roughness values according to ISO 8791-2:2013 in the range of 70 ml/min to 600 ml/min.

DETAILED DESCRIPTION OF THE INVENTION

The invention is explained in more detail below with reference to exemplary embodiments.

Example 1: Production of a Packaging Paper with a Basis Weight (Grammage) of 60 g/m$^2$ Process Description:

An unbleached pulp consisting of 95% softwood (spruce) primary pulp having a kappa number of 42 and 5% hardwood (birch) primary pulp having a kappa number of 40, which was first subjected to high consistency refining with a refining power of 190 to 210 kWh/t, wherein a freeness of the pulp after the high consistency refining was 17° SR and subsequently this pulp was subjected to a low consistency refining with a refining power of 75 kWh/t, wherein the freeness of the pulp after the high consistency refining and the low consistency refining was 22° SR, was used.

In the approach flow system, the agents (Aluminum Sulfate, cationic starch, and a mixture of Alkenyl Succinic Anhydride (ASA) and Alkylated Ketene Dimers (AKD)) are added. Here, the pH was adjusted with Aluminum Sulfate to a pH of 6.8 to 7.1, cationic starch, with a cationization degree DS of 0.03, was added in an amount of 10 kg/t paper absolutely dry as well as 1 kg/t of a dry strengthener (Glyoxylated Polyacrylamide (G-PAM)), and a mixture of ASA and AKD in an amount of 0.4 kg/t paper adry (absolutely dry) [atro—absolut trocken] was used as a sizing agent. The pulp did not contain any fillers. The consistency of the pulp at the headbox was 0.21%. Dewatering was carried out on a Fourdrinier section, and with a press section with three nips, with line pressures at the three nips being 55 kN/m, 80 kN/m, and again 80 kN/m. Before the still moist paper was fed to the Clupak system, it was pre-dried in a slalom dryer section and treated and micro creped in a Clupak system at a differential speed of −5.2%. The paper was dried to a residual moisture content of 9% before being calendered and finally wound up in a soft nip calender with a line load of 45 kN/m and a temperature of 100° C. The paper can be used as such.

The paper had the paper properties described in Table 1 below:

TABLE 1

| Paper Property | Norm | Unit | Direction | Result |
|---|---|---|---|---|
| Grammage | ISO 536: 2019 | g/m$^2$ | | 60 |
| Tensile Strength | ISO 1924-3: 2005 | kN/m | MD | 4.9 |
| Tensile Strength Index | ISO 1924-3: 2005 | Nm/g | MD | 81.7 |
| Tensile Strength | ISO 1924-3: 2005 | kN/m | CD | 3.3 |
| Tensile Strength Index | ISO 1924-3: 2005 | Nm/g | CD | 55 |
| Elongation at break | ISO 1924-3: 2005 | % | MD | 6.7 |
| Elongation at break | ISO 1924-3: 2005 | % | CD | 7.3 |
| Tensile fracture work index | ISO 1924-3: 2005 | J/g | MD | 3.4 |
| Tensile fracture work index | ISO 1924-3: 2005 | J/g | CD | 2.9 |
| Air Permeability Gurley | ISO 5636-5: 2013 | s | | 14.3 |
| Cobb Value 60 s | ISO 535: 2014 | g/m$^2$ | | 32 |
| Bendtsen Roughness | ISO 8791-2: 2013 | ml/min | smooth side | 298 |
| Bendtsen Roughness | ISO 8791-2: 2013 | ml/min | rough side | 819 |

Needless to say, the paper can additionally be subjected to a coating treatment, such as extrusion coating with polyethylene (e.g., 4.0 g/m$^2$) or, after a pigmenting precoat with kaolin, a dispersion coating (1.8 g/m$^2$), which can further modify the properties, especially roughness and air permeability.

Example 2: Production of a Packaging Paper with a Basis Weight of 81 g/m$^2$

Process Description:

An unbleached pulp consisting of 100% softwood primary pulp (mixture of spruce and pine) with a kappa number of 47, which was first subjected to high consistency refining with a refining power of 210 to 220 kWh/t, wherein a freeness of the pulp after the high consistency refining was 18° SR and subsequently this pulp was subjected to low consistency refining with a refining power of 80 kWh/t, wherein the freeness of the pulp after the high consistency refining and the low consistency refining was 24° SR was used.

In the approach flow system of the paper machine, the additives are metered in. Here, the pH was adjusted with Aluminum Sulfate to a pH of 6.6 to 7.1, cationic starch, with a cationization degree DS of 0.03, was added in an amount of 13 kg/t paper adry, and alkenyl succinic anhydride was used as a sizing agent in an amount of 0.5 kg/t paper adry. 2% filler in the form of talc was added. The consistency of the pulp at the headbox was 0.19%. Dewatering was carried out on a Fourdrinier section, and with a press section with three nips, with line pressures at the three nips being 60 kN/m, 80 kN/m, and again 80 kN/m. Before the still moist paper was fed to the Clupak system, it was pre-dried in a slalom dryer section and treated and (micro)creped in a Clupak system at a differential speed of −6.1%. The paper was dried to a residual moisture content of 10.5% before calendering and final rewinding in a soft-nip calender with a line load of 57 kN/m at a temperature of 110° C. The paper can be used as such.

The paper had the paper properties described in Table 2 below:

TABLE 2

| Paper Property | Norm | Unit | Direction | Result |
|---|---|---|---|---|
| Grammage | ISO 536: 2019 | g/m$^2$ | | 81 |
| Tensile Strength | ISO 1924-3: 2005 | kN/m | MD | 6.5 |
| Tensile Strength Index | ISO 1924-3: 2005 | Nm/g | MD | 80.2 |
| Tensile Strength | ISO 1924-3: 2005 | kN/m | CD | 4.7 |
| Tensile Strength Index | ISO 1924-3: 2005 | Nm/g | CD | 58.0 |
| Elongation at break | ISO 1924-3: 2005 | % | MD | 8.0 |
| Elongation at break | ISO 1924-3: 2005 | % | CD | 7.1 |
| Tensile fracture work index | ISO 1924-3: 2005 | J/g | MD | 3.4 |
| Tensile fracture work index | ISO 1924-3: 2005 | J/g | CD | 2.8 |
| Air Permeability Gurley | ISO 5636-5: 2013 | s | | 18.7 |
| Cobb Value 60 s | ISO 535: 2014 | g/m$^2$ | | 30 |
| Bendtsen Roughness | ISO 8791-2: 2013 | ml/min | smooth side | 241 |
| Bendtsen Roughness | ISO 8791-2: 2013 | ml/min | rough side | 857 |

The paper can additionally be subjected to a coating treatment, such as extrusion coating with polyethylene (e.g., 4.0 g/m$^2$ on the smoothed side or e.g., 6.0 g/m$^2$ on at least one side), whereby the properties, in particular roughness and air permeability, can be changed.

Such a paper was printed in a flexographic printing process with a multicolor print. The colors showed a high brilliance and bleeding of the same could not be observed.

In two further tests, sample packages were made from the paper, one batch in which the coated side of the paper formed the inside of the package and one batch in which the coated side of the paper formed the outside of the package. Both batches of packages were filled with sand, 25 kg, gravel, 25 kg, rice 15 kg, children's play stones, wood chips 10 kg, and 2 kg of nails, sealed, and subjected to load tests in each case. The load tests here consisted of drop tests from a constant drop height of 0.8 meters with a flat drop in accordance with ISO 7965-1:1984.

In the case of packages where the coated side of the paper forms the inside of package, packaging I, the closing was performed by heat sealing and in cases where the coated side of the paper forms the outside of the package, packaging II, the closing was performed by means of a conventional adhesive.

These tests showed that the packaging I and II made from the packaging paper according to the present invention did not break even after 9 to 10 drops, and the pointed or sharp-edged filling materials also did not pierce the paper.

Both groups of packages, packaging I and II, were also printed in multiple colors on the outside using flexographic printing. The packaging I could be printed on well, the colors did not run out and did not flow into each other, the color brilliance was sufficient. The feel of packaging I corresponded to that of, for example, natural brown paper bags. Significantly less ink was required for printing packaging II compared to packaging I, the color brilliance was excellent, and no merging or bleeding of colors was observed. The drying time of the inks was somewhat prolonged compared to packaging I. After drying and after the drop tests as described above, it was found that the color print on both packaging I and II was neither chipped nor smudged or damaged in any way.

Thus, these tests show that, depending on the desired feel of the packaging and the brilliance of the print applied to it, as well as possibly the goods to be packaged in it, the packaging paper can be used with its coated side facing both inwards and outwards.

Example 3: Production of a Packaging Paper with a Basis Weight (Grammage) of 138 g/m$^2$ Process Description:

An unbleached pulp consisting of 80% softwood primary pulp (spruce and pine) with a kappa number of 45 and 15% hardwood primary pulp (birch and beech) with a kappa number of 40, which was first subjected to high consistency refining with a refining power of 190 to 210 kWh/t, where a freeness of the pulp after the high consistency refining was 17° SR, and subsequently this pulp was subjected to low consistency refining with a refining power of 75 kWh/t, where the freeness of the pulp after the high consistency refining and the low consistency refining was 23° SR, was used. Likewise, 5% recovered paper was used, but this was only added to the stock stream after refining.

In the approach flow system of the paper machine, the additives were metered in. Here, the pH was adjusted with Aluminum Sulfate to a pH of 7.0 to 7.2, cationic starch, with a cationization degree DS of 0.04, was added in an amount of 13 kg/t paper adry, and Alkenyl Succinic Anhydrides were used as sizing agents in an amount of 0.7 kg/t paper adry (absolutely dry). Furthermore, no fillers were added. The consistency of the pulp at the headbox was 0.25%. Dewatering was carried out on a Fourdrinier wire section and with a press section with three nips, one of which may be a shoe press, where the line pressure at the three nips was 60 kN/m, 90 kN/m and 500 kN/m (in the shoe press), respectively.

Before the still moist paper was fed to the Clupak system, it was pre-dried in a slalom dryer section and treated and (micro)creped in a Clupak system at a differential speed of −4.2%. The paper was dried to a residual moisture content of 9% before calendering and final rewinding in a soft-nip calender with a line load of 37 kN/m and a temperature of 110° C. The paper can be used as such.

The paper had the paper properties described in Table 3 below:

TABLE 3

| Paper Property | Norm | Unit | Direction | Result |
|---|---|---|---|---|
| Grammage | ISO 536: 2019 | $g/m^2$ | | 138 |
| Tensile Strength | ISO 1924-3: 2005 | kN/m | MD | 11.5 |
| Tensile Strength Index | ISO 1924-3: 2005 | Nm/g | MD | 83.3 |
| Tensile Strength | ISO 1924-3: 2005 | kN/m | CD | 8.2 |
| Tensile Strength Index | ISO 1924-3: 2005 | Nm/g | CD | 59.4 |
| Elongation at break | ISO 1924-3: 2005 | % | MD | 5.9 |
| Elongation at break | ISO 1924-3: 2005 | % | CD | 6.1 |
| Tensile fracture work index | ISO 1924-3: 2005 | J/g | MD | 3.0 |
| Tensile fracture work index | ISO 1924-3: 2005 | J/g | CD | 2.6 |
| Air Permeability Gurley | ISO 5636-5: 2013 | s | | 26.9 |
| Cobb Value 60 s | ISO 535: 2014 | $g/m^2$ | | 28 |
| Bendtsen Roughness | ISO 8791-2: 2013 | ml/min | smooth side | 334 |
| Bendtsen Roughness | ISO 8791-2: 2013 | ml/min | rough side | 1264 |

The paper thus obtained was extrusion coated on one side with 7 $g/m^2$ polyethylene on the smooth side (the side facing the calender roll). After coating, the Bendtsen roughness of the smooth side was 78 ml/min and the air permeability has decreased to 15400 seconds according to ISO 5636-5:2013 (Gurley).

Such a paper was printed using a flexographic printing process with a multicolor print. The colors showed a high brilliance and bleeding of the same could not be observed.

In another test, test packages such as bags, sacks or pouches were made from the paper and filled with sand, 25 kg, gravel, 25 kg, rice 15 kg, children's play stones, wood chips 10 kg, and 2 kg of nails, heat-sealed and subjected to load tests in each case. The load tests here consisted of drop tests from a constant drop height of 0.8 meters with a flat drop in accordance with ISO 7965-1:1984

These tests showed that the packages made from the packaging paper according to the present invention did not break even after 9 to 10 drops, nor did the pointed or sharp-edged filling materials pierce through the paper, and finally the color printing did not flake off or become smudged or damaged in any other way.

Example 4: Production of a Packaging Paper with a Basis Weight of 80 $g/m^2$ Process Description:

An unbleached pulp consisting of 100% softwood primary pulp (mixture of spruce and pine) with a kappa number of 52, which was first subjected to high consistency refining with a refining power of 220 to 230 kWh/t, wherein a freeness of the pulp after the high consistency refining was 17° SR and subsequently this pulp was subjected to low consistency refining with a refining power of 90 kWh/t, wherein the freeness of the pulp after the high consistency refining and the low consistency refining was 22° SR was used.

In the approach flow system of the paper machine, the additives are metered in. Here, the pH was adjusted with Aluminum Sulfate to a pH of 6.6 to 7.1, cationic starch, with a cationization degree DS of 0.03, was added in an amount of 13 kg/t paper adry, and Alkenyl Succinic Anhydride was used as a sizing agent in an amount of 0.5 kg/t paper adry. 2% filler in the form of talc was added. The consistency of the pulp at the headbox was 0.19%. Dewatering was carried out on a Fourdrinier section, and with a press section with three nips, with line pressures at the three nips being 60 kN/m, 80 kN/m, and again 80 kN/m. Before the still moist paper was fed to the Clupak system, it was pre-dried in a slalom dryer section and treated and (micro)creped in a Clupak system at a differential speed of −6.1%. The paper was dried to a residual moisture content of 10.5% before being calendered and finally wound up in a soft-nip calender with a top roll having an Ra value of 0.03 μm with a line load of 65 kN/m and a temperature of 120° C. The paper can be used as such.

The paper had the paper properties described in Table 4 below:

TABLE 4

| Paper Property | Norm | Unit | Direction | Result |
|---|---|---|---|---|
| Grammage | ISO 536: 2019 | $g/m^2$ | | 80 |
| Tensile Strength | ISO 1924-3: 2005 | kN/m | MD | 6.5 |
| Tensile Strength Index | ISO 1924-3: 2005 | Nm/g | MD | 80.2 |
| Tensile Strength | ISO 1924-3: 2005 | kN/m | CD | 4.7 |
| Tensile Strength Index | ISO 1924-3: 2005 | Nm/g | CD | 58.0 |
| Elongation at break | ISO 1924-3: 2005 | % | MD | 7.9 |
| Elongation at break | ISO 1924-3: 2005 | % | CD | 7.0 |
| Tensile fracture work index | ISO 1924-3: 2005 | J/g | MD | 3.4 |
| Tensile fracture work index | ISO 1924-3: 2005 | J/g | CD | 2.8 |
| Air Permeability Gurley | ISO 5636-5: 2013 | s | | 20.2 |
| Cobb Value 60 s | ISO 535: 2014 | g/m2 | | 28 |
| Bendtsen Roughness | ISO 8791-2: 2013 | ml/min | smooth side | 93 |
| Bendtsen Roughness | ISO 8791-2: 2013 | ml/min | rough side | 790 |

The paper can additionally be subjected to a coating treatment, such as extrusion coating with Polyethylene (e.g., 3.8 $g/m^2$ on the smoothed side or e.g., 6.0 $g/m^2$ on at least one side), whereby the properties, in particular roughness and air permeability, can be changed.

Example 5: Production of a Packaging Paper with a Basis Weight of 100 $g/m^2$ Process Description:

An unbleached pulp consisting of 100% softwood primary pulp (mixture of spruce and pine) with a kappa number of 53, which was first subjected to high consistency refining with a refining power of 220 to 230 kWh/t, wherein a freeness of the pulp after the high consistency refining was 17° SR and subsequently this pulp was subjected to low consistency refining with a refining power of 90 kWh/t, wherein the freeness of the pulp after the high consistency refining and the low consistency refining was 22° SR was used.

In the approach flow system of the paper machine, the additives are metered in. Here, the pH was adjusted with Aluminum Sulfate to a pH of 6.6 to 7.1, cationic starch, with a cationization degree DS of 0.03, was added in an amount of 13 kg/t paper adry, and Alkenyl Succinic Anhydride was used as a sizing agent in an amount of 0.5 kg/t paper adry. 2% filler in the form of talc was added. The consistency of the pulp at the headbox was 0.2%. Dewatering was carried out on a Fourdrinier section, and with a press section with three nips, with line pressures at the three nips being 60 kN/m, 80 kN/m, and again 80 kN/m. Before the still moist paper was fed to the Clupak system, it was pre-dried in a slalom dryer section and treated and (micro)creped in a Clupak system at a differential speed of −6.1%. The paper was dried to a residual moisture content of 10.5% before being calendered and finally wound up in a soft-nip calender with a top roll having an Ra value of 0.03 μm with a line load of 25 kN/m and a temperature of 120° C. The paper can be used as such.

The paper had the paper properties described in Table 5 below:

TABLE 5

| Paper Property | Norm | Unit | Direction | Result |
|---|---|---|---|---|
| Grammage | ISO 536: 2019 | $g/m^2$ | | 100 |
| Tensile Strength | ISO 1924-3: 2005 | kN/m | MD | 7.9 |
| Tensile Strength Index | ISO 1924-3: 2005 | Nm/g | MD | 79 |
| Tensile Strength | ISO 1924-3: 2005 | kN/m | CD | 5.9 |
| Tensile Strength Index | ISO 1924-3: 2005 | Nm/g | CD | 59 |
| Elongation at break | ISO 1924-3: 2005 | % | MD | 8.0 |
| Elongation at break | ISO 1924-3: 2005 | % | CD | 7.3 |
| Tensile fracture work index | ISO 1924-3: 2005 | J/g | MD | 3.4 |
| Tensile fracture work index | ISO 1924-3: 2005 | J/g | CD | 2.8 |
| Air Permeability Gurley | ISO 5636-5: 2013 | s | | 18.9 |
| Cobb Value 60 s | ISO 535: 2014 | $g/m^2$ | | 27 |
| Bendtsen Roughness | ISO 8791-2: 2013 | ml/min | smooth side | 421 |
| Bendtsen Roughness | ISO 8791-2: 2013 | ml/min | rough side | 898 |

The paper can additionally be subjected to a coating treatment, such as extrusion coating with Polyethylene (e.g., 5.0 $g/m^2$ on the smoothed side or e.g., 7.0 $g/m^2$ on at least one side), whereby the properties, in particular roughness and air permeability, can be changed.

Example 6: Production of a Packaging Paper with a Basis Weight (Grammage) of 140 $g/m^2$ Process Description:

An unbleached pulp consisting of 80% softwood primary pulp (spruce and pine) with a kappa number of 40 and 15% hardwood primary pulp (birch and beech) with a kappa number of 40, which was first subjected to high consistency refining with a refining power of 180 to 200 kWh/t, where a freeness of the pulp after the high consistency refining was 17° SR, and subsequently this pulp was subjected to low consistency refining with a refining power of 70 kWh/t, where the freeness of the pulp after the high consistency refining and the low consistency refining was 23° SR, was used.

In the approach flow system of the paper machine, the additives were metered in. Here, the pH was adjusted with Aluminum Sulfate to a pH of 7.0 to 7.2, cationic starch, with a cationization degree DS of 0.04, was added in an amount of 13 kg/t paper adry, and Alkenyl Succinic Anhydrides were used as sizing agents in an amount of 0.7 kg/t paper adry (absolutely dry). Furthermore, no fillers were added. The consistency of the pulp at the headbox was 0.25%. The Dewatering was carried out on a Fourdrinier wire section and with a press section with three nips, one of which may be a shoe press, where the line pressure at the three nips was 60 kN/m, 90 kN/m and 500 kN/m (in the shoe press), respectively.

Before the still moist paper was fed to the Clupak system, it was pre-dried in a slalom dryer section and treated and (micro)creped in a Clupak system at a differential speed of −4.2%. The paper was dried to a residual moisture content of 9.5% before calendering and final rewinding in a soft-nip calender with a line load of 20 kN/m and a temperature of 110° C. The paper can be used as such.

The paper had the paper properties described in Table 3 below:

TABLE 6

| Paper Property | Norm | Unit | Direction | Result |
|---|---|---|---|---|
| Grammage | ISO 536: 2019 | $g/m^2$ | | 140 |
| Tensile Strength | ISO 1924-3: 2005 | kN/m | MD | 11.6 |
| Tensile Strength Index | ISO 1924-3: 2005 | Nm/g | MD | 82.9 |
| Tensile Strength | ISO 1924-3: 2005 | kN/m | CD | 8.1 |
| Tensile strength index | ISO 1924-3: 2005 | Nm/g | CD | 57.9 |
| Elongation at break | ISO 1924-3: 2005 | % | MD | 6.0 |
| Elongation at break | ISO 1924-3: 2005 | % | CD | 6.4 |
| Tensile fracture work index | ISO 1924-3: 2005 | J/g | MD | 3.0 |
| Tensile fracture work index | ISO 1924-3: 2005 | J/g | CD | 2.7 |
| Air Permeability Gurley | ISO 5636-5: 2013 | s | | 25.2 |
| Cobb Value 60 s | ISO 535: 2014 | $g/m^2$ | | 27 |
| Bendtsen Roughness | ISO 8791-2: 2013 | ml/min | smooth side | 561 |
| Bendtsen Roughness | ISO 8791-2: 2013 | ml/min | rough side | 1242 |

The paper thus obtained was extrusion coated on one side with 7 $g/m^2$ Polyethylene on the smooth side (the side facing the calender roll). After coating, the Bendtsen roughness of the smooth side was 112 ml/min, and the air permeability has decreased to 14900 seconds according to ISO 5636-5: 2013 (Gurley).

Such a paper was printed using a flexographic printing process with a multicolor print. The colors showed a high brilliance and bleeding of the same could not be observed.

The invention claimed is:

1. Packaging paper consisting of an unbleached kraft paper with a kappa value according to ISO 302:2015 of between 38 and 60, as base paper, which is optionally coated on at least one side, the kraft paper being made of at least 90% primary pulp, having a basis weight according to ISO 536:2019 of between 60 $g/m^2$ and 150 $g/m^2$ and an air resistance according to ISO 5636-5:2013 (Gurley) of between 5 and 30 seconds, wherein the primary pulp contained in the base paper comprises at least 80% pulp with an average length-weighted fiber length according to ISO 16065-2:2014 of between 2.0 mm and 2.9 mm and less than 4.5% fillers as well as cationic starch in an amount of 0.5% by weight % to 1.5% by weight of the base paper, and contains other processing agents, that the base paper has an elongation at break in the machine direction according to ISO 1924-3:2005 of between 2.5% and 8.5%, and in that the packaging paper has a Bendtsen roughness according to ISO 8791-2:2013 of between 70 ml/min and 600 ml/min.

2. The packaging paper according to claim 1, wherein the base paper is coated on at least one side with a coating material selected from the group consisting of Polyethylene, Polypropylene, Polyolefin-based Copolymers and Terpolymers, and Ionomers or from the group of Polyolefin-free coating materials.

3. The packaging paper according to claim 1, wherein the coating is applied to each side of the base paper is an amount between 1% and 7% by weight of the basis weight of the base paper.

4. The packaging paper according to claim 1, wherein it contains 100% primary pulp.

5. The packaging paper according to claim 1, wherein the primary pulp consists of a mixture consisting of at least 80% softwood pulp with an average length-weighted fiber length according to ISO 16065-2:2014 of at least 2.0 mm, and the remainder hardwood pulp with an average length-weighted fiber length according to ISO 16065-2:2014 of at least 1.0 mm.

6. The packaging paper according to that claim 1, wherein the primary pulp is contained as refined pulp with a Schopper-Riegler freeness according to ISO 5267-1:1999 between 13°SR to 20°SR.

7. A process for the production of a packaging paper, in which an unbleached kraft pulp consisting of at least 90% of primary pulp, containing at least 80% pulp with an average length-weighted fiber length according to ISO 16065-2:2014 of between 2.0 mm and 2.9 mm and less than 4.5% fillers as well as cationic starch in an amount of 0.5% by weight to 1.5% by weight of the base paper, and other processing agents, with a kappa value according to ISO 302:2015 of between 38 and 60 is used as the base material, wherein the base material is creped in a Clupak plant until an elongation at break in the machine direction according to ISO 1924-3: 2005 of between 2.5% and 8.5% is achieved, dried to a moisture content of at most 14% and subjected to a calendering step, that a packaging paper with a Bendtsen roughness according to ISO 8791-2: 2013 of between 70 ml/min and 600 ml/min a basis weight according to ISO 536:2019 of between 60 g/m2 and 150 g/m2 and an air resistance according to ISO 5636-5:2013 (Gurley) of between 5 and 30 seconds is formed, and that optionally at least one one-sided coating of the packaging paper is carried out.

8. The process according to claim 7, wherein the calendering step is carried out in a shoe calender with a line load between 200 and 1000 kN/m and a shoe length of 50 mm-270 mm or a soft-nip calender with a line load of 18 to 80 kNim.

9. The process according to claim 7, wherein the calendered base paper is subjected to a coating step in which at least one side of the base paper is coated, with a coating material selected from the group consisting of Polyethylene, Polypropylene, Polyolefin-based Copolymers and Terpolymers, and ionomers or from the group of Polyolefin-free coating materials.

10. The process according to claim 7, wherein in the coating step an amount between 2% and 7%, of the basis weight of the base paper is applied to each side of the base paper to be coated.

11. The process according to claim 7, wherein the coating is applied to at least one side creped in the Clupak unit.

* * * * *